US005722480A

United States Patent [19]

Asai et al.

[11] Patent Number: 5,722,480

[45] Date of Patent: Mar. 3, 1998

[54] PROCESS FOR CONTINUOUS CASTING OF MOLTEN METAL AND APPARATUS FOR THE SAME

[75] Inventors: Shigeo Asai, 112, Yakushiyama, Narumi-cho, Midori-ku, Nagoya-shi, Aichi; Takehiko Toh, Chiba; Kiyoshi Wajima, Chiba; Kenzo Sawada, Chiba; Eiichi Takeuchi, Chiba; Kensuke Sassa, Aichi, all of Japan; Tingju Li, Dalian, China

[73] Assignees: Nippon Steel Corporation, Tokyo; Shigeo Asai, Aichi, both of Japan

[21] Appl. No.: 628,698

[22] PCT Filed: Aug. 23, 1995

[86] PCT No.: PCT/JP95/01672

§ 371 Date: Apr. 17, 1996

§ 102(e) Date: Apr. 17, 1996

[87] PCT Pub. No.: WO96/05926

PCT Pub. Date: Feb. 29, 1996

[30] Foreign Application Priority Data

| | | | |
|---|---|---|---|
| Aug. 23, 1994 | [JP] | Japan | 6-198597 |
| Sep. 21, 1994 | [JP] | Japan | 6-226372 |
| Sep. 21, 1994 | [JP] | Japan | 6-226373 |

[51] Int. Cl.[6] ..... B22D 27/02; B22D 11/07

[52] U.S. Cl. ..... 164/466; 164/502

[58] Field of Search ..... 164/466, 468, 164/502, 504

[56] References Cited

FOREIGN PATENT DOCUMENTS

| | | | |
|---|---|---|---|
| 57-21408 | 5/1982 | Japan . | |
| 64-83348 | 3/1989 | Japan . | |
| 2-37943 | 2/1990 | Japan . | |
| 4-13445 | 1/1992 | Japan | 164/502 |
| 4-64772 | 10/1992 | Japan . | |
| 4-319056 | 11/1992 | Japan . | |

*Primary Examiner*—Kuang Y. Lin

*Attorney, Agent, or Firm*—Pollock, Vande Sande & Priddy

[57] ABSTRACT

An object of the present invention is to provide a process for continuously casting a molten metal which process suppresses the instability of the initial solidification and stably improves the lubrication and the surface properties of the cast metal, and an apparatus therefor, in the process for continuously casting a molten metal an alternating current is applied to an electromagnetic coil which is provided so that it surrounds a continuous casting mold wall or is embedded in the side wall of the mold, whereby an electromagnetic force is exerted on the molten metal poured into the mold which either oscillates in a constant mode or does not oscillate and is starting to be solidified the process of the present invention also comprises periodically changing the amplitude or waveform of the alternating current to be applied, and the apparatus of the present invention is used for the process.

18 Claims, 16 Drawing Sheets

PROCESS FOR CONTINUOUS CASTING OF MOLTEN METAL AND APPARATUS FOR THE SAME

FIELD OF THE INVENTION

The present invention relates to a process for continuous casting of a molten metal. The present invention relates to a process for continuous casting of a molten metal comprising repeatedly changing a property, such as an amplitude, a frequency or a phase, of an alternating current to be exerted so that an electromagnetic force is applied to the molten metal to separate it from the mold, whereby the instability of the initial solidification is suppressed while imparting an operation for lubrication between the mold and the molten metal and a surface property improvement is effected.

BACKGROUND OF THE INVENTION

In continuous casting, powder is generally added to the upper surface of a molten metal pool within a mold. The powder is melted by heat from the molten metal, and the relative movement of the mold wall oscillating up and down and the solidified shell being drawn at a constant rate causes the molten powder to flow into a gap between the wall and the shell. The meniscus and the tip of the solidified shell are deformed by dynamic pressure generated during the inflow of the molten powder. Since the deformation is repeated at the cycle of the mold oscillation, periodic shrinkages, termed oscillation marks, are formed on the cast metal surface.

The formation of regular oscillation marks having a depth of an ordinary magnitude is known to contribute to the stabilization of casting operation and the cast slab surface quality. However, when the oscillation marks are excessively deep, cast metal surface defects may be formed. Moreover, in addition to the problem that the marks themselves are overly deep, there arise problems in, for example, that positive segregation of Ni is formed in the mark bottom portion and surface grinding the cast slab surface is required when austenitic stainless steel is continuously cast, and that an increase in the number of bubbles and inclusions trapped in the marks is observed as the marks are formed even when common steel is cast. In some cases, even the yield of the cast slab is lowered.

On the other hand, rape seed oil was previously used in place of the powder in continuously casting a metal having a small cross section, for example, a billet. In such continuous casting of metal having a small cross section wherein teeming is conducted without using an immersion nozzle, the powder cannot be used because powder is entrained by the teeming flow. It is known that the rape seed oil burns in the meniscus to form graphite, which prevents the solidified shell from sticking the mold wall. However, it is difficult to obtain regularly formed distinct oscillation marks on the surface of the resultant cast slab. The stability of the casting operation and that of the cast metal quality are inferior compared with the stability in casting using the powder.

As a method for controlling the initial solidification as described above, Japanese Unexamined Patent Publication (Kokai) No. 52-32824 has proposed a method for improving the surface properties of cast slab in a process for continuous casting by teeming a molten metal 2 together with a lubricant 4 into a water-cooled mold 1 which oscillates at a constant cycle and continuously drawing downward, the method comprising continuously applying an alternating current to an electromagnetic coil 5 provided around the periphery of the mold as shown in FIG. 2 so that the electromagnetic force generated by the alternating electromagnetic field makes the molten metal 2 form a convex curve. Moreover, Japanese Unexamined Patent Publication (Kokai) No. 64-83348 proposes a method for further improving the surface properties in powder casting at the time of imparting an electromagnetic force to a molten metal within a mold, using an electromagnetic coil, by intermittently applying an electromagnetic force through imparting the alternate magnetic field in a pulse form as shown in FIG. 3.

As disclosed in Japanese Unexamined Patent Publication (Kokai) No. 52-32824, the surface properties of the cast slab have been improved by continuously applying an electromagnetic force to the molten metal within a mold using an electromagnetic coil. However, the applied electromagnetic field not only changes the meniscus configuration but also heats the molten metal which is solidifying within a mold. As a result, the initial solidification does not necessarily progressed stably. Furthermore, as disclosed in Japanese Unexamined Patent Publication (Kokai) No. 64-83348, when an electromagnetic force is intermittently applied to a molten metal within a mold with an electromagnetic coil, the inflow of powder between the solidified shell and the mold wall is accelerated, and the surface properties of the cast slab are improved. However, in the case of a rapid on-off pattern as shown in FIG. 3, a wave motion is sometimes generated on the surface of the molten metal pool. The wave motion causes a problem in that it remains during a non-current stage, so that turbulence of the meniscus of the molten metal pool takes place to exert adverse effects on the application of an electromagnetic force and sometimes causes powder trapping in the solidified shell in an extreme case. On the other hand, in a continuous process in which a lubricant such as powder flowing between the solidified shell and the mold as a liquid state from the meniscus is not used, the casting operation and the surface properties of the cast slab must be improved so that they become the same as those after casting using powder.

Furthermore, Japanese Unexamined Patent Publication (Kokai) No. 2-37943 discloses a method for improving the surface properties without using a conventional lubricant such as powder and rape seed oil by initiating solidification at a level lower than the meniscus to exclude the turbulence of the meniscus. In the method, such a refractory material having a predetermined electric conductance as graphite and alumina graphite is used as a mold, and the mold is made to generate heat by an electromagnetic coil provided therearound so that the solidification level of the steel is controlled. Thus, the method makes it possible to continuously cast while the molten metal is solidified under the molten metal surface. According to the patent mentioned above, when a molten metal solidifies on a heated mold wall, a solid-liquid coexisting phase inevitably exists immediately before the portion which becomes a complete solid phase in the drawing direction of the cast slab. Since the solid-liquid coexisting phase portion does not have a sufficient strength, the portion sometimes remains separately at the time of drawing the cast slab. Consequently, it has been impossible to stably conduct casting operation. As described above, the applied electromagnetic force is also exerted on the molten metal to decrease contact pressure between the metal and the mold, namely to decrease contact resistance therebetween. When the force is increased for the purpose of stabilizing initial solidification, the amounts of heat generated in the mold and the metal increase and, as a result, stabilization has not been achieved.

An object of the present invention is to provide a process for continuously casting molten metal which solves the problems caused by the conventional casting process imparting an electromagnetic force, and which restrains the instability of the initial solidification and stably achieves the effects of improving lubrication and the effects of improving the surface properties of the cast metal. A further object of the present invention is to simultaneously provide a process for continuously casting molten metal without using powder which process stabilizes the initial solidification influencing the surface properties of the cast slab with stabilization of the casting operation.

SUMMARY OF THE INVENTION

As shown in the schematic view of the principle of the generation of electromagnetic force in FIG. 17, in the process for continuously casting a molten metal in the present invention, an alternating current is applied to a solenoidal electromagnetic coil 5 which is provided so that it surrounds a continuous casting mold or is embedded in the side wall of the mold, and continuous casting is conducted while an electromagnetic force 18 is applied to a molten metal 2 which has been poured into the mold and which immediately starts to solidify. The direction of the electromagnetic force 18 is determined by the direction of an induction current 20 and that of an induction magnetic field 19, and in the present invention the electromagnetic force is always exerted on the molten metal 2 in such a direction that the molten metal 2 is separated from the wall of a mold 1. In the process, the alternating current to be applied is made step-like as shown in FIG. 1 and, as shown in FIG. 1(*a*), a large current stage is designated as $t_1$ and a small current stage is designated as $t_2$. A large current for applying an electromagnetic force necessary for changing the meniscus configuration is combined with small current having a function different from that which changes the meniscus configuration, before and after the large current. Alternatively, as shown in FIG. 1(*b*), a large current is applied to impart an electromagnetic force necessary for changing the meniscus configuration, and then a small current is applied to obtain a function different from that which changes the meniscus configuration. A pair of the current applications or a plurality of pairs thereof are conducted, and subsequently a non-current stage ($t_{off}$) is provided, whereby the instability of the initial solidification of the molten metal generated during continuous current or pulsed current (the application stage being termed $t_{on}$) is suppressed and the effects of improving lubrication and improving the surface properties of the cast slab are stably obtained. Furthermore, in the above current application, the proportion of the large current application time effecting the meniscus deformation to the current application time within one period is preferably determined to be at least 0.2 and up to 0.8. As a result, the effects of improving lubrication between the mold wall and the solidified shell and improving the surface properties of the cast slab can be maximized.

Furthermore, in a process for continuously casting a molten metal without using the powder or using a substance such as rape seed oil which does not exist as a liquid state in the meniscus of the molten metal, the alternating current is applied to an electromagnetic coil provided so that the coil surrounds a continuous casting mold, and as a result an electromagnetic force is intermittently applied to the meniscus of the molten metal within the mold. Consequently, the periodic deformation and overflow of the metal which is solidifying in the meniscus are accelerated, and regular oscillation marks are obtained. It becomes thus possible to stabilize the initial solidification in continuous casting. That is, the concrete technical features of the process are as described below.

First, an alternating current which is periodically changed in its amplitude, frequency, phase, or the like, namely its waveform is applied to a solenoidal electromagnetic coil provided around the outer periphery of a continuous casting mold which oscillates with a constant period. As a result, an electromagnetic force which changes in accordance with the alternating current is applied to a molten metal poured into the mold.

When the period of applying the electromagnetic force is synchronized with the period of the mold oscillation and the application stage is conformed to the negative strip stage, uniform oscillation marks are formed in the peripheral direction of the cast slab surface. A cast slab having good surface properties can thus be obtained. Moreover, when the stage of applying the electromagnetic force conforms to the positive strip stage, the formation of oscillation marks on the cast slab surface is suppressed, and a cast slab having a smooth surface can be obtained.

Secondly, a periodically changing alternating current is applied to a solenoidal electromagnetic coil provided around the outer periphery of the wall of a continuous casting mold without oscillation, and as a result an electromagnetic force which changes in accordance with the alternating current is applied to a molten metal poured into the mold. Marks equivalent to oscillation marks are thus formed on the cast slab surface.

In the first and the second process, there are three procedures as mentioned below as concrete means for applying a periodically changing alternating current to an electromagnetic coil, whereby an electromagnetic force changing in accordance with the alternating current is applied to a molten metal poured into a mold.

(1) A pulsed alternating current is applied to the electromagnetic coil so that one period of the electromagnetic waveform becomes an intermittent magnetic field formed by an alternating magnetic field application stage and an alternating magnetic field nonapplication stage, whereby an intermittent electromagnetic force is applied to the molten metal poured into the mold.

(2) An alternating current, changing while having strong and weak amplitudes, is applied to the electromagnetic coil so that a nonapplication stage of alternating magnetic field is not present in one period of the resulting electromagnetic waveform, whereby an electromagnetic force which changes in accordance with the amplitude of the alternating current is applied to the molten metal poured into the mold.

(3) An alternating current changing while having high and low frequencies is applied to the electromagnetic coil so that a nonapplication stage of alternating magnetic field is not present in one period of the resulting electromagnetic waveform, whereby an electromagnetic force which changes in accordance with the frequency of the alternating current is applied to the molten metal poured into the mold. Among these procedures, the procedures (2) and (3) are step-like current procedures, which will be described later, and impact step-like electromagnetic waveforms.

In the procedures as mentioned above, the desired stable control becomes possible by changing the alternating current applied to the electromagnetic coil in manners as described below, regardless of whether or not the powder is used.

That is, when the mold oscillates, the frequency of the mold oscillation ($f_m$) and the frequency of the alternating current ($f_p$) are set in the range defined by the formula: $0.69 \leqq \ln(f_p/f_m) \leqq 9.90$. A modulated current is applied to the electromagnetic coil in place of periodically stressing and weakening the amplitude of an alternating current applied to the electromagnetic coil, and the frequency of signal waves of the modulated current is set at the frequency of the mold oscillation. In addition, the frequency of carrier waves ($f_c$) of the modulated current and the frequency of the mold oscillation ($f_m$) are set in a range defined by the formula: $0.69 \leqq \ln(f_c/f_m) \leqq 9.90$. An amplitude-modulated current, a frequency-modulated current or phase-modulated current is selected as the modulated current. When the mold does not oscillate, a frequency in the range from 1 to 5 Hz, which is usually used for the mold oscillation, is selected as $f_c$.

BRIEF DESCRIPTION OF THE DRAWINGS

FIG. 4(*b*) shows a static meniscus configuration during the nonapplication of an electromagnetic force. FIG. 4(*c*) shows a solidified shell configuration after repeating the application and nonapplication of an electromagnetic force.

FIG. 5(*b*) shows a mode including two small current application stages and a group of large current stages each having a current different from the others, the group existing between the two small current stages. FIG. 5(*c*) shows a mode including a group of large current stages each having a current different from the others, a small current stage subsequent to the group and a non-current stage.

BEST MODE FOR CARRYING OUT THE INVENTION

Figure 4A:
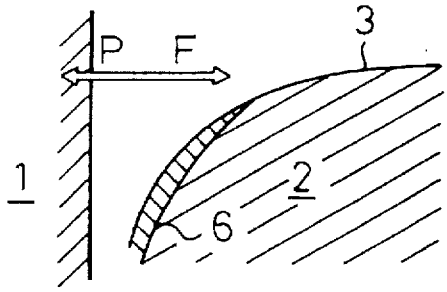
FIG. 4(*a*) shows a deformed meniscus form during the application of an electromagnetic force.
Figure 4B:
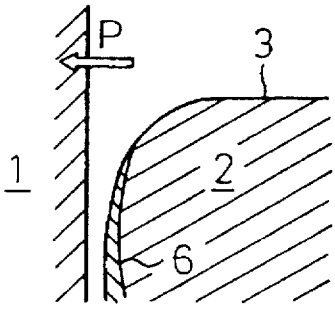
Figure 4C:
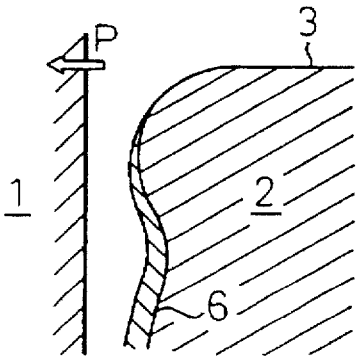

Japanese Unexamined Patent Publication (Kokai) No. 64-83348 illustrates in detail the effects of accelerating a powder inflow to an initial solidification portion and the effects of improving the surface properties of a cast slab by the application of an electromagnetic force in continuously casting a molten metal. That is, as shown in FIG. 4(*a*), a gap between the mold and the tip of a solidified shell 6 is enlarged when the electromagnetic force is applied. As shown in FIG. 4(*b*), the tip of the solidified shell 6 is pushed back to the mold wall side by the static pressure P of a molten metal 2 when the electromagnetic force is subsequently off. The periodic repetition of "on" and "off" forms a constriction in the solidified shell 6 as shown in FIG. 4(*c*). The necking formation is repeated, and consequently the supply of the powder as a lubricant between the mold and the solidified shell is accelerated. The present inventors have conducted casting experiments using a low melting point alloy. As a result, they have proved the effects of intermittently applying an electromagnetic force by applying a continuous current and a pulsed current as described above. They have also found that defects associated with the instability at initial solidification are formed on a casting carried out in a magnetic field formed by the simple application of a continuous current or pulsed current. That is, when a continuous current is simply applied, a molten metal which is solidifying is heated by a current which is induced in the molten metal and which contributes to the meniscus configuration change, and solidification does not proceed sufficiently. As a result, the powder inflow sometimes becomes insufficient, and the surface properties of the cast slab sometimes become deteriorated.

Figure 3:
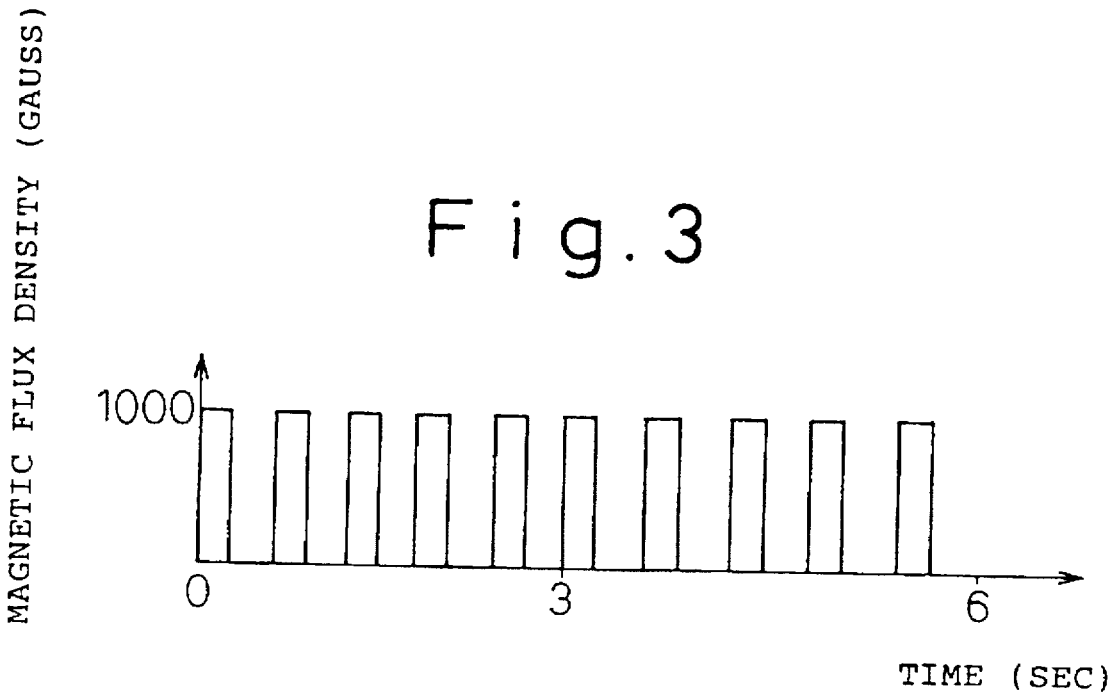
FIG. 3 shows a mode imparting a pulsed electromagnetic field which mode has heretofore been proposed.
Figure 13:
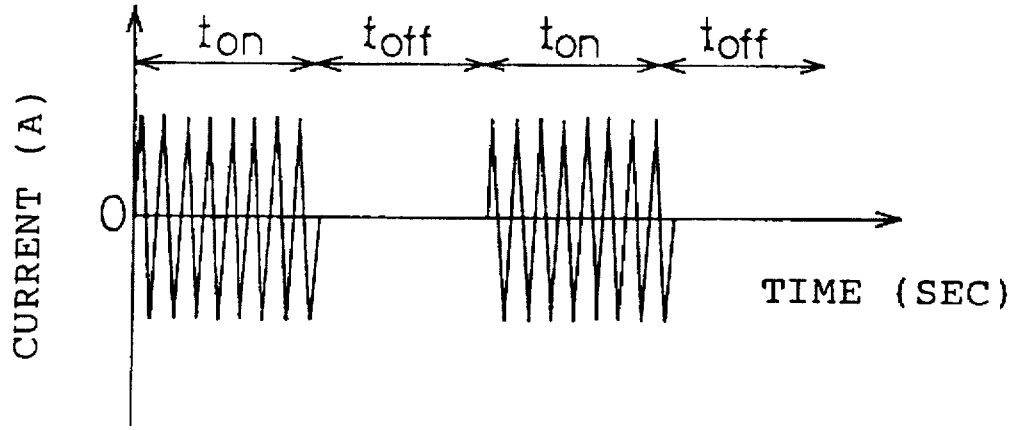
FIG. 13 shows a pulsed current waveform applied to the electromagnetic coil in the process in FIG. 1.

When there is applied a simple pulsed current consisting of a no current stage $t_{off}$ and a current stage $t_{on}$ as shown in FIG. 13 for imparting a magnetic flux as shown in FIG. 3, the current amplitude becomes instantly 0 from a maximum value. The resultant drastic meniscus configuration change causes a wave motion on the meniscus surface of the molten metal pool. The powder is sometimes included in the molten metal by turbulence caused by the wave motion, and trapped by the solidified shell to form surface defects.

The present inventors have solved the problems as mentioned above by applying an alternating current which periodically changes in a manner represented by a step-like change, as shown below, to the electromagnetic coil.

Figure 1A:
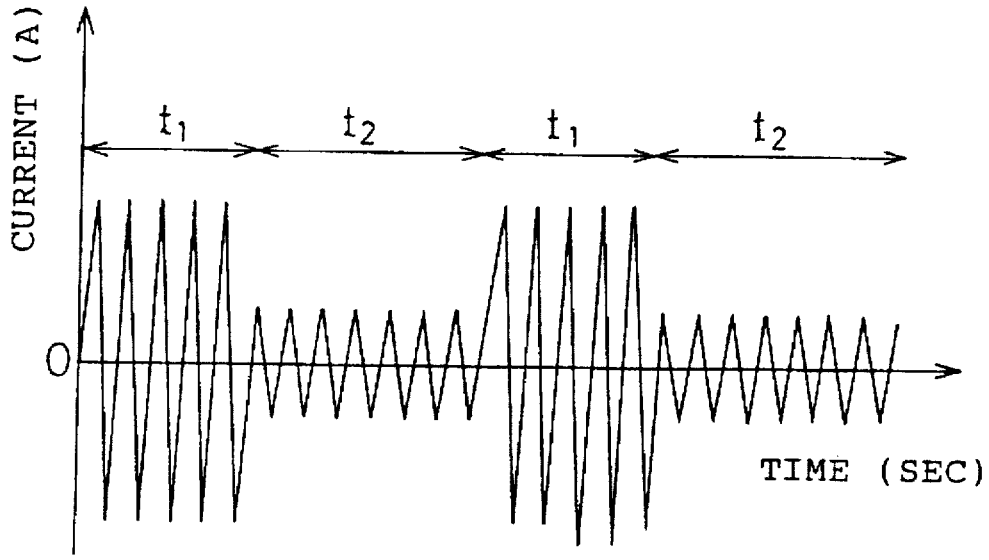
FIG. 1(*a*) shows a step-like current application mode without including non-current stage, and FIG. 1(*b*) shows a step-like current application mode with including a no current stage.
Figure 1B:
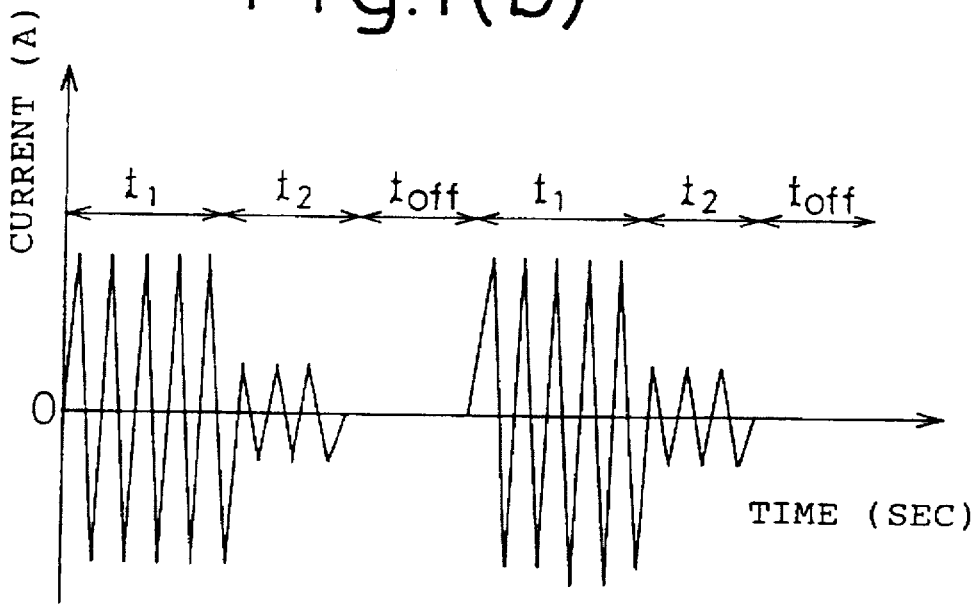
Figure 2:
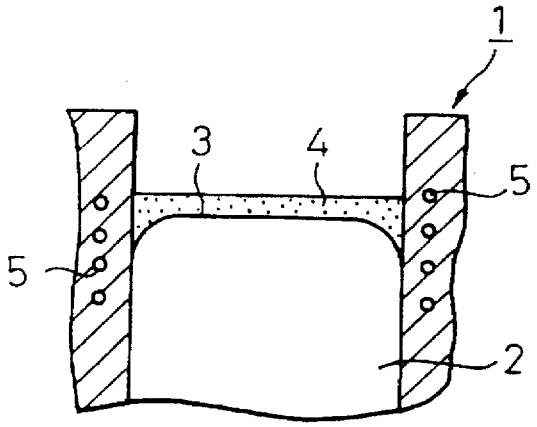
FIG. 2 shows a configurational relationship among an electromagnetic coil incorporated into a continuous casting mold, a molten metal meniscus and powder.

FIG. 1 shows waveforms of currents in the application of a step-like current. As shown in FIG. 1(*a*), one period of current application in the step-like current application consists of a large current stage $t_1$ and a small current stage $t_2$. As a result, when the electromagnetic force is not completely turned off but there is provided a small current stage which does not contribute to the meniscus deformation but is effective in stabilizing the meniscus, the turbulence of the meniscus of the molten metal pool is greatly decreased, and the problem of powder entrainment is solved. Moreover, it has become possible to suppress heat generation and allow the initial solidification to proceed stably by selecting the large current stage $t_1$ and the small current stage $t_2$ within the response time of the movement of the molten metal. In addition, as shown in FIG. 1(*b*), a mode of periodically repeating a large current, a small current immediately thereafter and no current is also effective as the step-like current application.

Figure 5A:
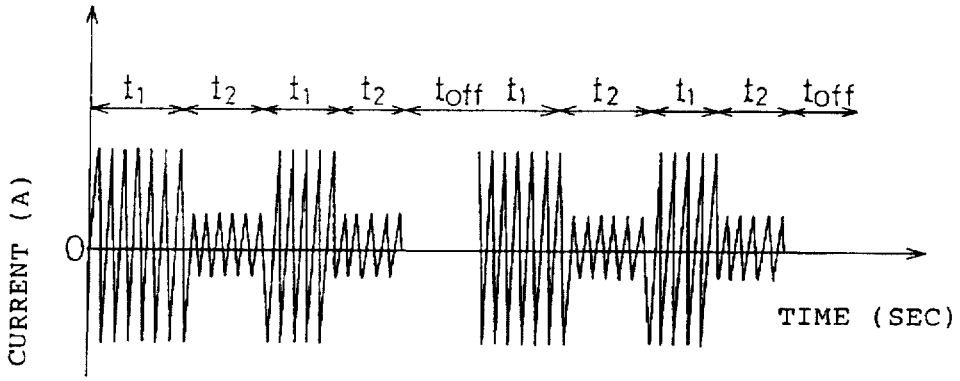
FIG. 5 (*a*) shows a mode including large current and a small current stages repeated a plurality of times and a subsequent non-current stage.
Figure 5B:
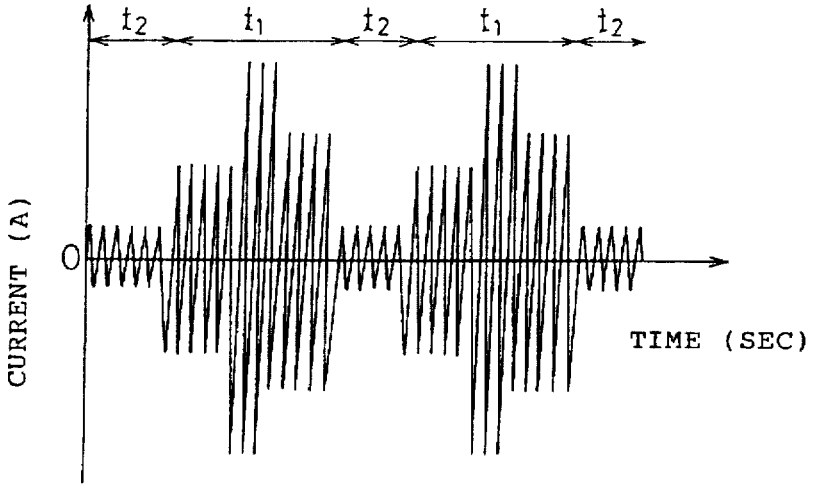
Figure 5C:
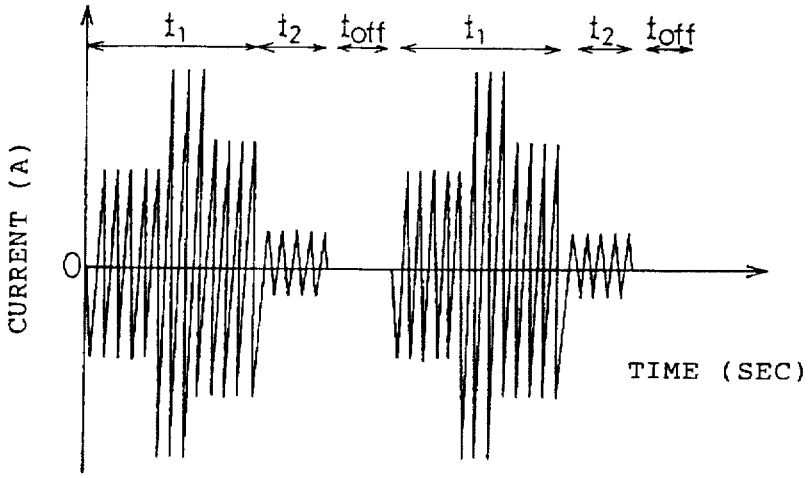

Furthermore, various modes for the step-like current application can be selected as shown in FIG. 5, and the modes are effective in stabilizing the target effects while the turbulence during application of the pulsed current is being suppressed. For example, FIG. 5(*a*) shows a mode wherein a combination of large current and subsequent small current is repeated at least twice, a no current stage is then provided, and a combination of current and no current is periodically repeated. Moreover, a mode in FIG. 5(*c*) is obtained by adding a no current stage after the small current stage of a mode in FIG. 5(*b*), and repeating the combination thus obtained. Application of a combination of a large current and a small current as a group as shown in FIG. 5 is effective in stably advancing the growth of the initial solidification shell without delay while the molten metal meniscus form is kept constant and the induced heat generation is suppressed.

Intermittent application of electromagnetic force by such a step-like current application exerts significant effects on stabilizing lubrication and the improvement of the cast slab surface quality in the case where the mold oscillates as well in the case where the mold does oscillate.

Furthermore, the present inventors have found that the effects of improving lubrication between the mold wall and the solidified shell and improving the surface quality of the cast slab can be maximized by setting the ratio of the large current time $t_1$ to the current application time $t_1+t_2$, namely $t_1/(t_1+t_2)$ in the range from 0.2 to 0.8. The lower limit of the ratio is determined from the current application time necessary for changing the meniscus form and accelerating the powder inflow. The upper limit of the ratio is determined from the small current time necessary for suppressing the turbulence of the meniscus and preventing heat generation. In addition, "powder" herein designates a lubricant which is generally used within the mold in continuous casting and which is melted on the meniscus of the molten metal pool, and is also termed flux.

Moreover, in a process for continuously casting a molten metal not using powder or using a substance such as rape seed oil which does not exist as a liquid state in the meniscus of the molten metal, the process becomes as described below.

The formation of oscillation marks on a cast slab surface plays an important part for the stabilized formation of the initial solidified shell. That is, it is essential for stably obtaining excellent surface properties of the cast slab to uniformly start solidification in the peripheral direction of the mold within the continuous casting mold, to uniformly start the solidification in the longitudinal direction of casting, and to regularly repeat the solidification in the longitudinal direction of casting. For example, when non-uniform solidification is started, surface cracks are formed and casting at a rate exceeding a certain value becomes difficult.

The present inventors have confirmed the facts as described below in the investigation and research of the initial solidification. That is, the powder becomes molten in the meniscus portion within the mold, and has a viscosity of at least a certain value. The molten powder, therefore, transmits the mold oscillation to the meniscus as dynamic pressure, and consequently accelerates regular deformation of the meniscus and regular overflow of the molten steel. The regular deformation and the regular overflow lead to the formation of regular and distinct oscillation marks.

Figure 10:
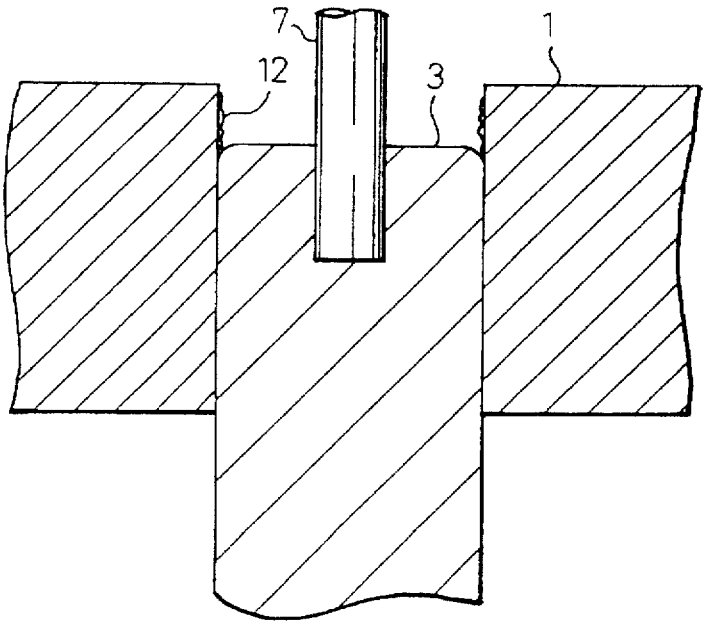
FIG. 10 shows a conventional process for continuously casting a molten metal using rape seed oil.

On the contrary, when a molten metal is continuously cast without using powder as shown in FIG. 10, the mold oscillation is not surely transmitted to the meniscus portion of the molten metal. For example, rape seed oil 12 used in casting a metal having a small cross section such as a billet contributes to lubrication not as a liquid state. The oil added in a trace amount along a copper plate of a continuous casting mold 11 mildly burns until it reaches a meniscus 3, and becomes graphite, which contributes to prevent of the sticking of the solidified shell to the mold wall. However, there is no medium which transmits the mold oscillation to the meniscus portion which is solidifying. Accordingly, regular oscillation marks are difficult to be formed on the cast slab, and good surface properties of the cast slab are often not obtained.

Figure 11:
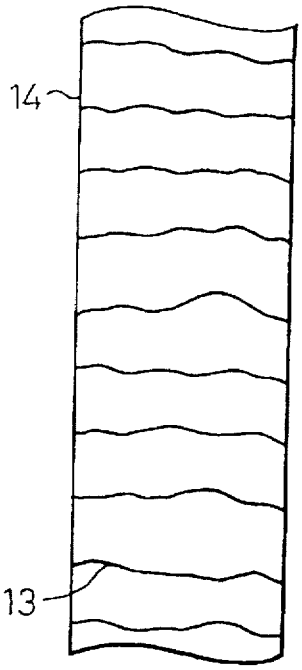
FIG. 11 shows the surface conditions of a cast billet obtained by the conventional process in FIG. 2.
Figure 12:
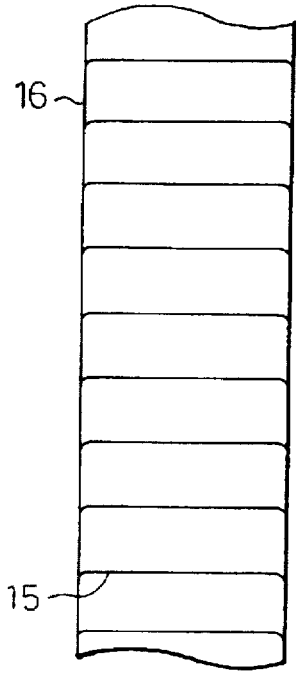
FIG. 12 shows the surface conditions of a cast billet obtained by the process in FIG. 1 according to the present invention.

Oscillation marks, though they are not distinct, are formed on a billet surface which is obtained by casting using rape seed oil. The mark formation mechanism is considered to be as described below in this case. The shell tip suffers deformation as the mold wall having been thermally deformed slightly at the meniscus oscillates especially during the stage where the mold is falling. The thermal deformation of the mold wall differs depending on the state of contact of the molten metal with the mold, and is not necessarily uniform in the peripheral direction. Oscillation marks 13 formed in such a case on the surface of the cast metal 14 as shown in FIG. 11 are evidently not good in uniformity in the peripheral direction, compared with oscillation marks 15 as shown in FIG. 12 formed when the powder is used. Accordingly, the casting operation and the surface properties of the cast metal thus obtained are neither stabilized nor good.

On the other hand, for the purpose of accelerating the supply of the powder between the solidified shell and the mold wall, the present inventors have invented a process comprising applying a pulsed alternating current as shown in FIG. 13 to an electromagnetic coil, which is provided in such a manner that it surrounds a continuous casting mold, to form a magnetic flux as shown in FIG. 3, whereby an alternating magnetic field is intermittently applied to the solidification initiation portion of the molten metal meniscus within the mold and an electromagnetic force which makes the portion repel the mold is repeatedly exerted thereon, and disclosed the process in Japanese Unexamined Patent Publication (Kokai) No. 64-83348. The present inventors have done further research in the case where a lubricant is not used or a substance such as rape seed oil which does not exist as a liquid in the meniscus is used, and discovered that the intermittent application of a magnetic field by the application of a pulsed current as shown in FIG. 13 greatly improves the initial solidification which has heretofore been unsatisfactory due to procedures relying on incompletely controlled mold deformation.

That is, an intermittent repulsive electromagnetic force is generated in the initial solidification portion by the application of an intermittent magnetic field to the meniscus. As a result, even when a substance such as the powder, which transmits the mold oscillation to the solidified shell, cannot be used periodic shell deformation and periodic molten metal overflow are surely generated to form regular oscillation marks by applying the intermittent repulsive magnetic field. It has thus become possible to ensure the stability of the solidification initiation in the peripheral direction of the cast slab.

Particularly when the repulsive magnetic field is applied in the negative strip stage where the lowering rate of the mold exceeds the casting rate, the oscillation marks can be surely formed. The mode is, therefore, most efficient in stabilizing the casting operation and the surface properties of the cast slab. On the other hand, when the repulsive magnetic field is applied in the positive strip stage during mold oscillation, the formation of oscillation marks is suppressed and a cast slab having a smooth surface can be obtained. Since the initial solidification is not necessarily stabilized in this case, care should be taken to carry out casting at a low casting rate. In addition, the application of an intermittent electromagnetic force by the application of a pulsed current signifies a mode consisting of an application stage and a nonapplication stage per period. Moreover, the application of an intermittent electromagnetic force by the application of a step-like current designates an application system consisting of a stage where the magnetic field strength is high and a stage where the magnetic field strength is low. Both modes have been confirmed to display sufficient effects. Controlling the magnetic field strength by the application of a step-like current is achieved by means such as adjusting the amplitude of an alternate current to be applied to the electromagnetic coil or adjusting the frequency thereof.

When continuous casting is conducted by applying mechanical oscillation to the mold, an alternating current is applied to the electromagnetic coil in a pulse form so that an electromagnetic force is exerted on the molten metal within the mold intermittently, regardless of powder casting or non-powder casting, and as a result the contact pressure between the mold and the cast slab can be intermittently decreased in the initial solidification portion. In continuous casting as described above, the electromagnetic force is exerted in the same period as that of the mold oscillation by setting the repeating frequency of stressing the amplitude of the applied current and weakening the amplitude thereof ($f_t$) at the frequency of the mold oscillation ($f_m$). As a result, it becomes possible to control overlaps of the solidified shell and overflow of the molten metal which cause the oscillation marks.

Figure 15:
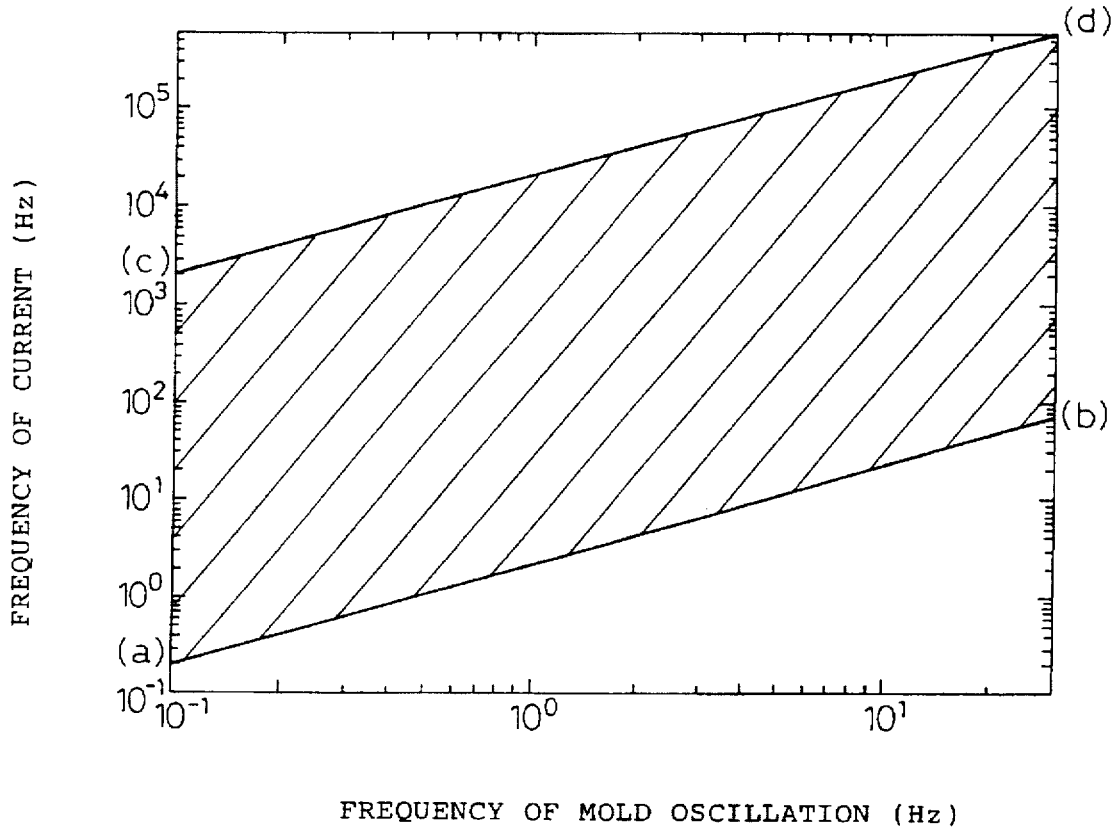
FIG. 15 shows a relationship between a frequency of mechanical oscillation of a mold and a frequency of a pulsed alternating current applied to a coil, for stably maintaining a meniscus.

In the case of carrying out continuous casting while mechanical oscillation is being applied to the mold, when the determination of a frequency of the pulsed alternate current ($f_p$) is inappropriate compared with a frequency of the mold oscillation ($f_m$), there arises a problem that stationary waves are generated in the meniscus of the molten metal to unstabilize the meniscus and the solidification. As a result of carrying out various investigations, it has been found that the interference of the molten metal surface vibration in the meniscus can be suppressed and the solidification can be stabilized by setting $f_m$ and $f_p$ in a range represented by the formula: $0.69 \leqq \ln(f_p/f_m) \leqq 9.90$ as shown in FIG. 15. The lower value of the $f_p/f_m$ ratio is restricted to stabilize the meniscus. The upper value thereof is restricted because of thermal restriction for stably developing the solidified shell.

The coil current which generates an intermittent electromagnetic force is not restricted to a pulsed or step-like alternating current. The electromagnetic force can be realized by a modulated current such as an amplitude-modulated current, a frequency-modulated current and a phase-modulated current. In such cases, the frequency of signal waves of the modulated current ($f_s$) corresponds to the repeating frequency of the stressed current amplitude and the weakened current amplitude ($f_t$) in the pulsed alternating current, and the frequency of carrier waves ($f_c$) corresponds to $f_p$. Accordingly, the same function as in the case of applying the pulsed alternating current mentioned above can be obtained by setting the frequency of the signal waves at the frequency of the mold oscillation, and by setting the frequency of the carrier waves ($f_c$) and the frequency of the mold oscillation ($f_m$) in a range defined by the formula: $0.69 \leqq \ln(f_c/f_m) \leqq 9.90$.

The control may be carried out to effect a lubrication aid function corresponding to mechanical oscillation, by the electromagnetic field even when the mold is not oscillated. Since $f_m$ is not present in this case, $f_c$ is usually selected from the range of about 1 to 5 Hz which is employed as $f_m$.

In the present invention, the frictional resistance between the solidified shell and the mold can be decreased even when a lubricant is not used by oscillating the cooling mold in the direction vertical to the casting direction through applying the step-like electromagnetic field as mentioned above. Moreover, when a lubricant is used, the frictional resistance between the solidified shell and the mold wall is further decreased, and a cast slab excellent in surface properties can be obtained by continuous casting. Furthermore, the process of the present invention may be applied to the process for continuously casting a metal by solidification under a molten metal surface using a heating mold as disclosed in Japanese Unexamined Patent Publication (Kokai) No. 2-37943. That is, when the applied electromagnetic field is made step-like, the solidifying metal softly contacts with the mold wall while predetermined heating is being conducted, by the strong pulsed electromagnetic force, whereby continuous casting by stabilized solidification under the molten metal surface may be realized.

EXAMPLES

Example 1

The characteristics of the present invention are explained below concretely by making reference to examples.

Figure 6:
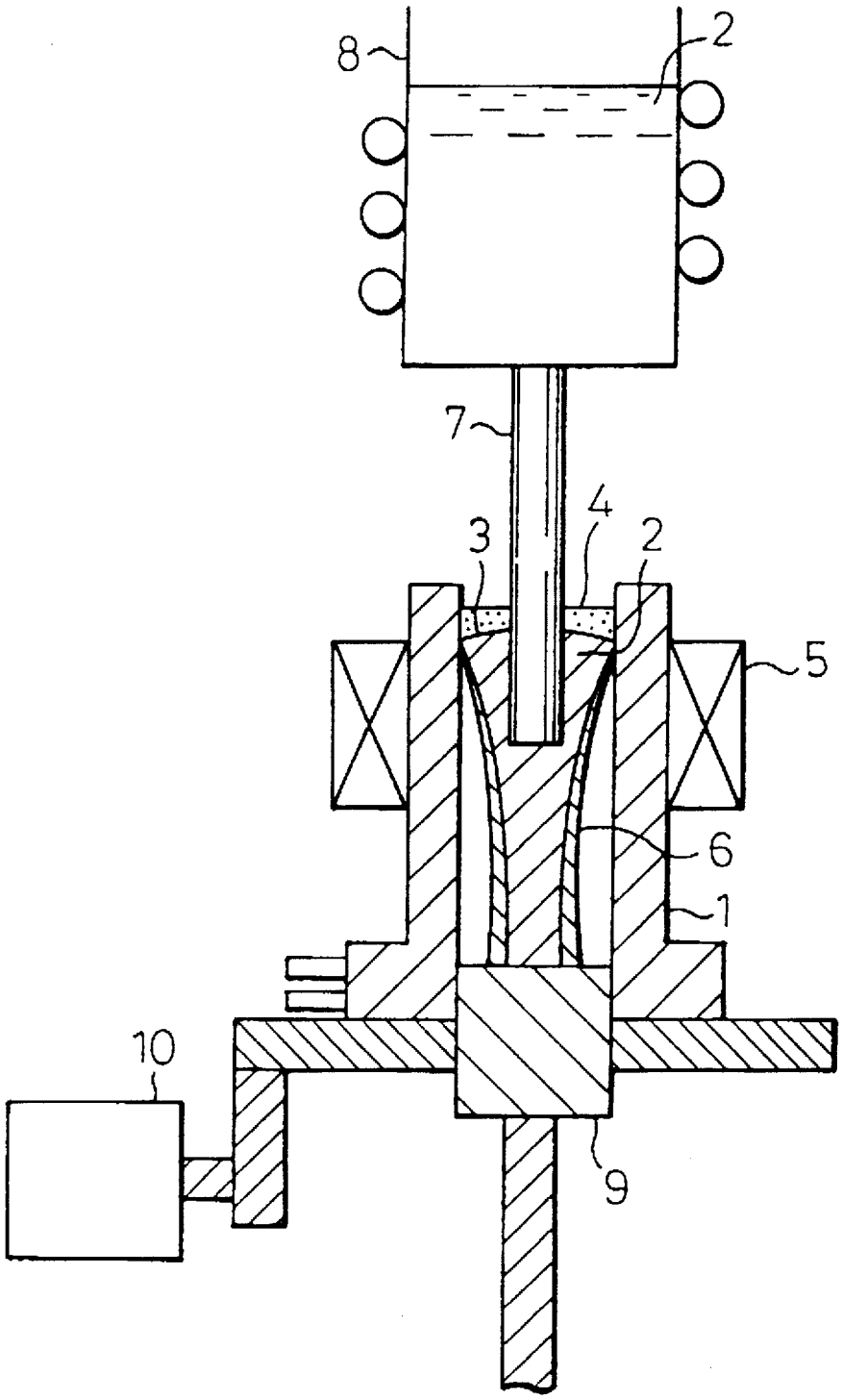
FIG. 6 shows an outline of an apparatus used for experiments in casting tin.
Figure 7:
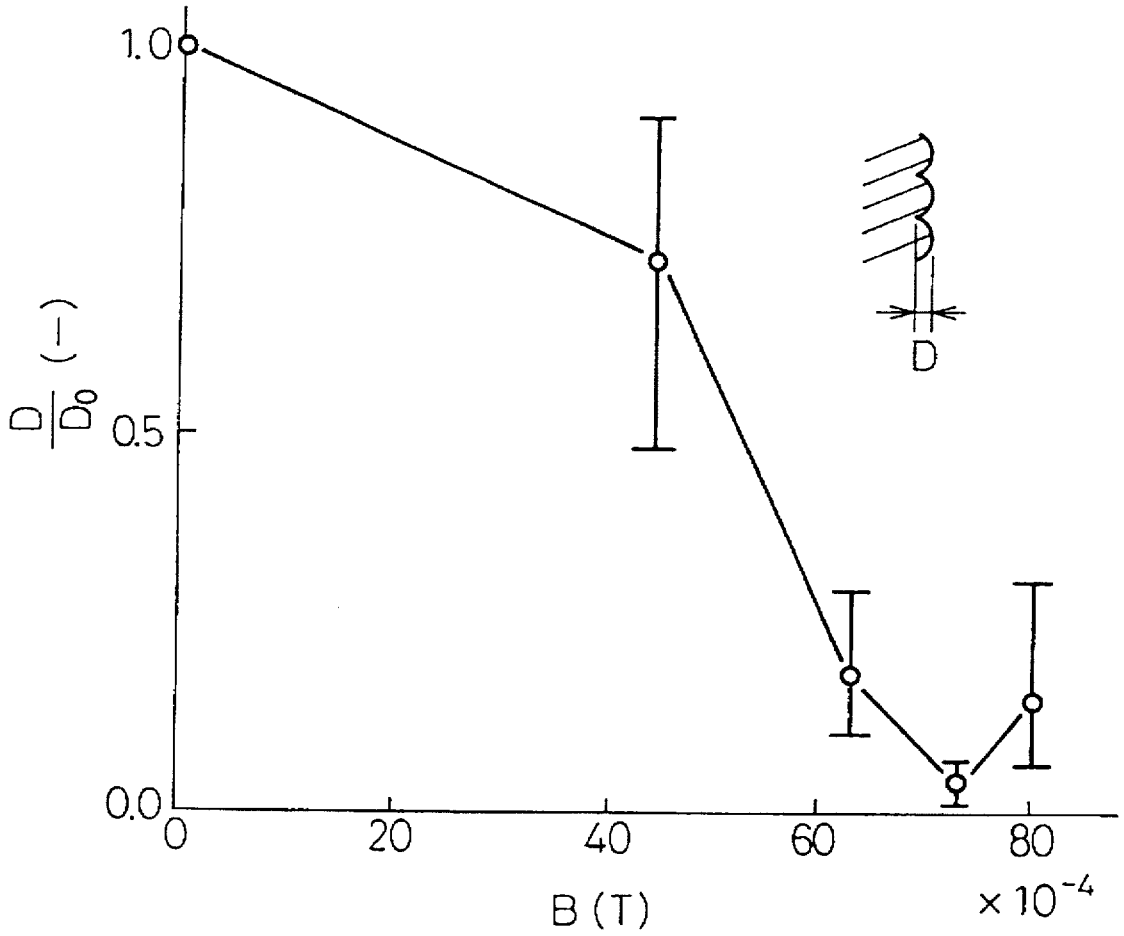
FIG. 7 shows a relationship between the surface roughness of a cast slab obtained by using the apparatus in FIG. 6 and applying a step-like current and a magnetic flux density within the mold.

Tin was cast using an apparatus as shown in FIG. 6. An electromagnetic coil was provided so that it surrounded a mold, and a step-like current having a pattern as shown in FIG. 1(*b*) was applied. Tin was cast into a cylindrical mold having a diameter of 3 cm at a rate of 12 cm/min while the mold was being oscillated at a frequency of 60 cycle/min with an oscillation stroke of 0.3 cm. For comparison, casting was conducted while a pulsed current as shown in FIG. 13 was being applied. The cycle of applying the step-like current and that of applying the pulsed current were each 60 cycle/min. When the step-like current was applied, the large current and the small current were set at 600 A and 180 A, respectively, and the ratio of a time of large current application to the entire period was set at 0.3. On the other hand, the pulsed current during its application was set at 600 A. The resultant cast slab was examined, and it was found that the ratio of an average depth of marks (D) formed on the cast tin surface when the electromagnetic force was applied to an average depth of marks ($D_0$) formed thereon when the electromagnetic force was not applied was up to 0.1 in both cases, this indicates that the surface properties were significantly improved. FIG. 7 shows the results of continuous casting while a step-like current was applied. A magnetic flux density of $73 \times 10^{-4}$ T corresponds to the conditions of the present example. The symbols in FIG. 7 indiate quantities as follows: B: a magnetic flux density (T), D: a surface roughness (having no dimension) of cast tin obtained when a magnetic field was applied, and $D_0$: a surface roughness (having no dimension) of cast tin obtained when a magnetic field was not applied.

On the other hand, the cast tin obtained by continuously casting while a simple pulsed current was applied showed a many traces of silicone oil, used as powder, on the cast tin surface. However, the cast tin obtained by continuously casting while a step-like current was applied showed no traces of silicone oil, the results regarding the silicone oil being the same as in the case of continuous casting without applying an electromagnetic force.

Example 2

A step-like current having a pattern as shown in FIG. 1(*a*) was applied under the conditions in Example 1. The current was applied at a frequency of 300 cycles/min, and the surface properties of the cast tin were compared with those of cast tin obtained when a continuous current was applied. As a result, the surface of cast tin obtained when the step-like current was applied was extremely smooth and had no defects, whereas many traces of molten metal bleed caused by improper progress of the initial solidification were found on the surface of cast tin obtained when a continuous current was applied.

Example 3

Figure 8:
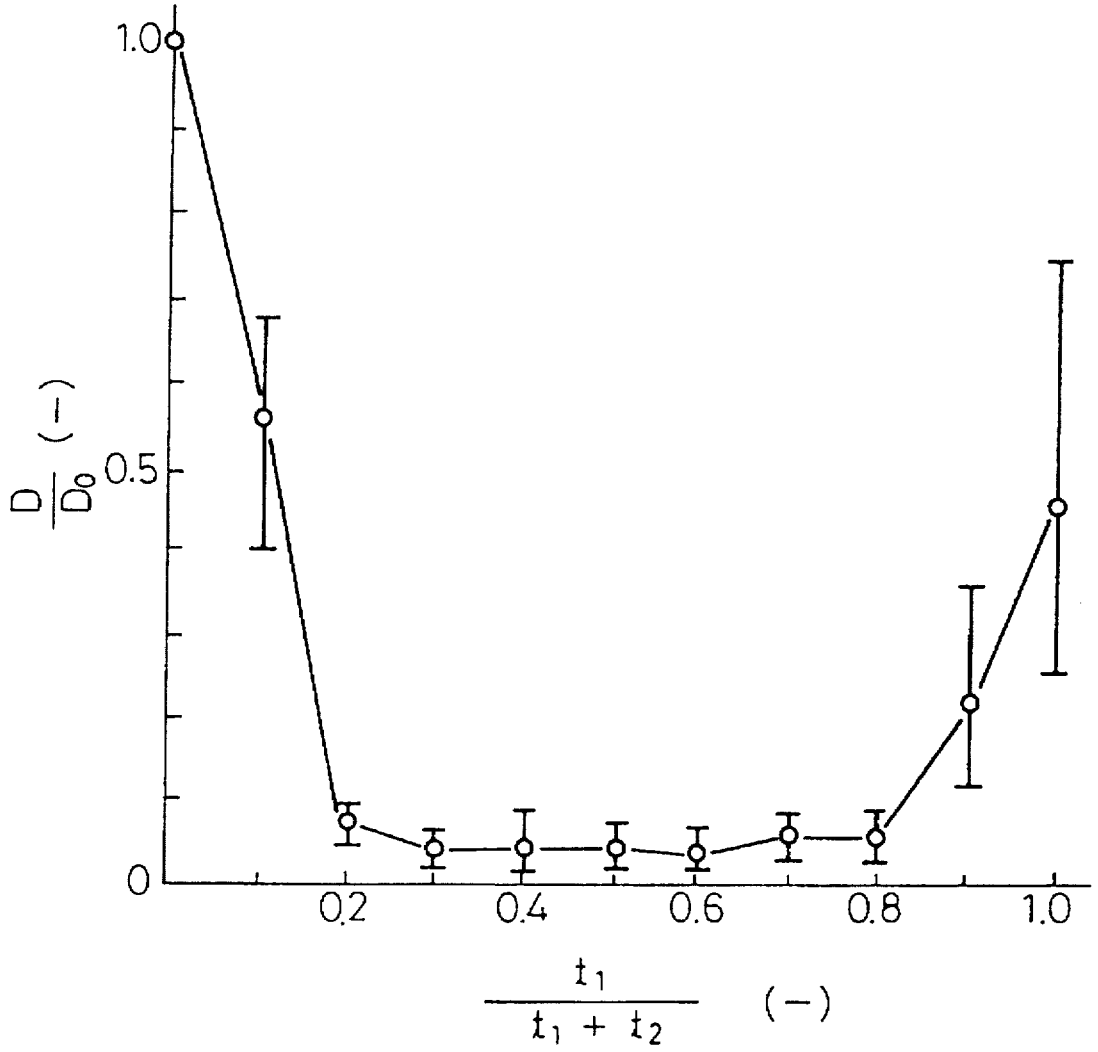
FIG. 8 shows a relationship between a surface roughness of a cast slab obtained by using the apparatus in FIG. 6 and the ratio of a time of large current application to the entire period.

Among the casting conditions, When applying a step-like current in Example 1, the ratio of the time of large current application ($t_1$) to the entire period ($t_1+t_2$) was varied from 0 to 1.0, and casting was conducted. FIG. 8 shows the change of the surface roughness, namely $D/D_0$ for different ratios. In FIG. 8, D designates the surface roughness (no dimension) of cast tin obtained when a magnetic field was applied, and $D_0$ designates the surface roughness (no dimension) of cast tin obtained when a magnetic field was not applied.

It is seen from the results that the index of the surface roughness $D/D_0$ became a minimum when the ratio of the time of applying a large amplitude current to the entire period was from 0.2 to 0.8.

It is evident from these examples that the application of a step-like current made it possible to accelerate powder lubrication and stably improve the surface properties of the cast metal.

Example 4

Figure 9:
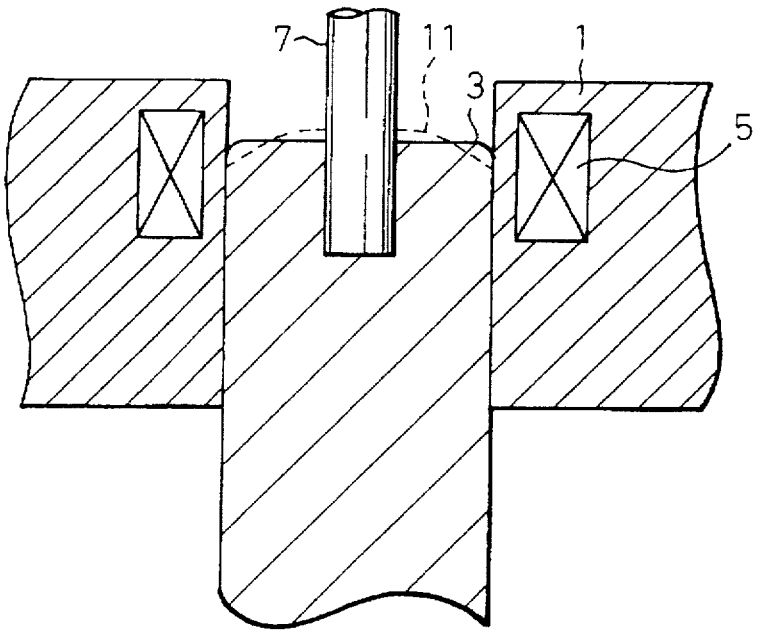
FIG. 9 shows a configurational relationship among a continuous casting mold, a meniscus and an electromagnetic coil according to the present invention.

FIG. 9 shows an outline of the apparatus used in the example of the present invention. An electromagnetic coil 5 was provided around the periphery of a mold 1, and a predetermined alternate magnetic field was intermittently applied. Using the apparatus, a common medium carbon steel was continuously cast into a billet. The casting conditions were as follows: a casting rate: 2.5 m/min, a cross sectional size of the mold: 130 mm×130 mm, an oscillation stroke of the mold: ±4 mm, and an oscillation frequency: 190 cpm. Casting was conducted while rape seed oil was being supplied in a trace amount from the upper part of a copper plate of the mold along the copper plate.

First, FIG. 11 shows the surface state of a cast billet 14 obtained when an electromagnetic force was not applied. Shrinkage was observed on the surface, and the spaces therebetween varied. However, the average value of the spaces was approximately equal to a value obtained by dividing the casting rate by the number of mold oscillations. Accordingly, the shrinkage is thought to have been formed by the mold oscillation. The cast slab had turbulence in the oscillation marks 13 as well as convexities and concaves, and partial longitudinal cracks. The billet, therefore, required conditioning. On the other hand, FIG. 12 shows the surface properties of a billet obtained by casting while a pulsed electromagnetic force was intermittently applied in the negative strip stage of the mold oscillation. Extremely distinct oscillation marks 15 were formed on the surface of the cast billet 16, and the billet had no surface defects.

Example 5

In carrying out casting experiments under the conditions in Example 4, a pulsed current was applied so that the electromagnetic force was applied in synchronization with the positive strip stage of the mold oscillation. Oscillation marks formed on the cast billet were very slight and the billet had an extremely smooth surface.

Example 6

Figure 14:
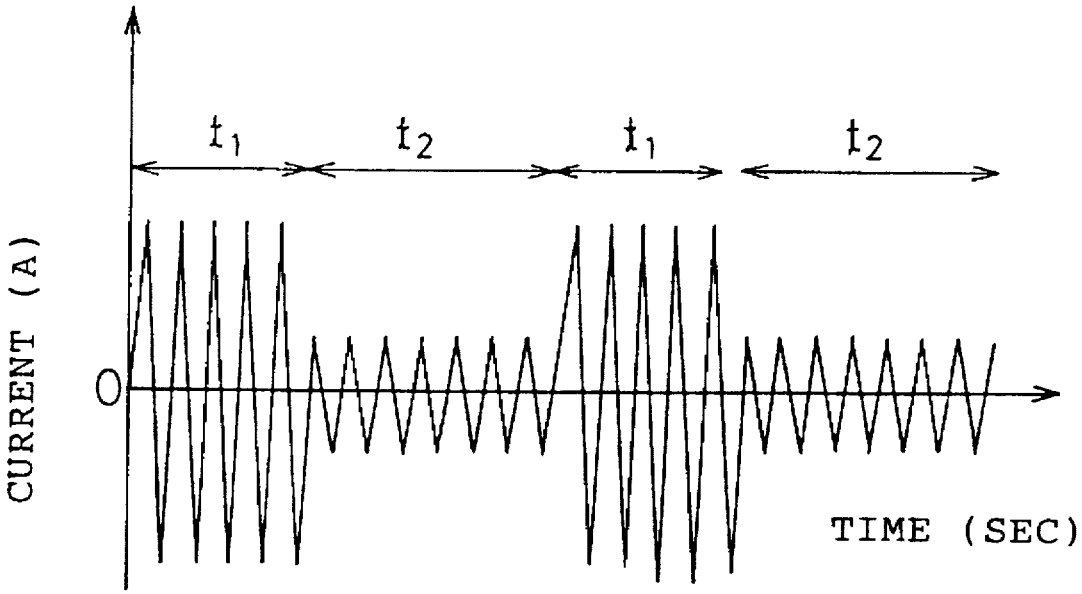
FIG. 14 shows a step-like current waveform applied to the electromagnetic coil in the process in FIG. 1.

In carrying out casting experiments under the conditions in Example 4, a step-like current as shown in FIG. 14 was applied to the electromagnetic coil. Although the cast tin obtained when a simple pulsed current was applied in comparative example in Example 1 had slight shrinkage among oscillation marks, the cast billet thus obtained had no such shrinkage.

The shrinkage was not formed because the wave motion in the meniscus generated during the application of the simple pulsed current was suppressed by the application of the step-like current.

Example 7

In carrying out casting experiments under the conditions of Example 4, casting was conducted without oscillating the mold. When casting was conducted without applying an electromagnetic force, the solidified shell frequently exhibited sticking on the mold wall, and many traces of bleed were found on the cast billet. In contrast to the casting mentioned above, when casting was carried out while a pulsed electromagnetic force was being applied, the casting was stabilized, and the cast billet thus obtained had distinct oscillation marks.

It is evident from these examples that in continuously casting a molten metal using no lubricant, distinct oscillation marks were formed on the cast slab surface by continuously casting while a pulsed electromagnetic force was being applied in synchronization with mold oscillation or without mold oscillation.

Example 8

Figure 18B:
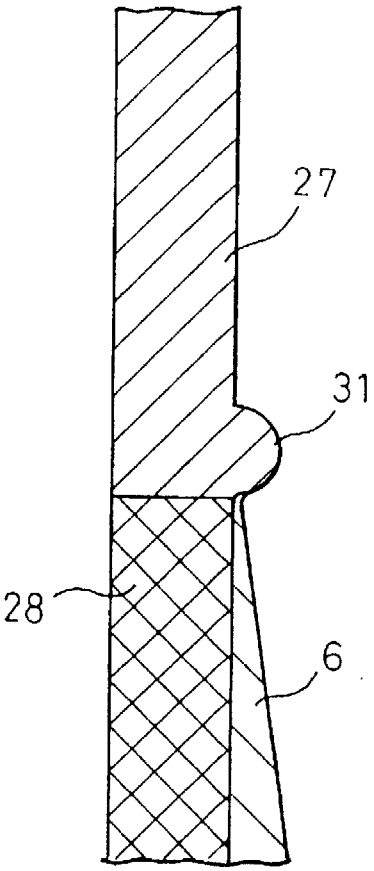
FIG. 18(*a*) shows an outline of the apparatus in FIG. 8, and FIG. 18(*b*) shows an enlarged view of the A portion in FIG. 18(*a*).
Figure 18A:
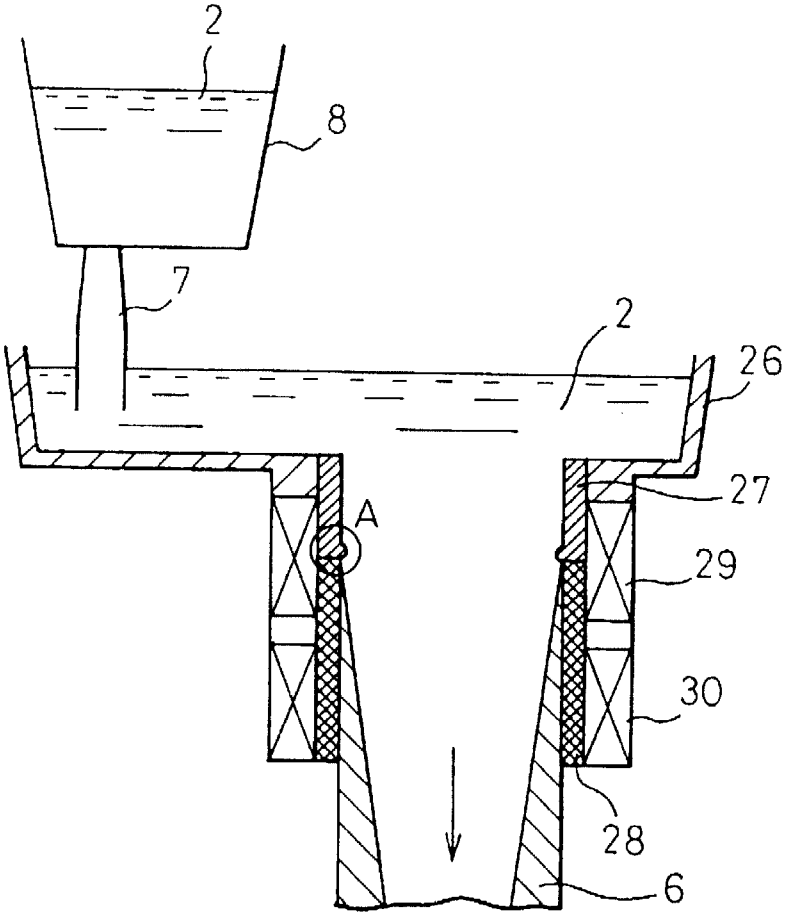

FIG. 18(*a*) shows an outline of an apparatus used in examples within the scope of claim 14 according to the present invention. FIG. 18(*b*) is a detail of the A portion in FIG. 18(*a*), and a reference numeral 31 designates a break ring portion. In FIG. 18, a high frequency electromagnetic coil 29 was provided around the upper periphery of a mold 1, and a high frequency magnetic field was applied. Moreover, a low frequency electromagnetic coil 30 was provided around the lower periphery thereof, and a low frequency magnetic field was applied. Using the apparatus, a common medium carbon steel was continuously cast into a billet.

The steel was continuously cast at a rate of 2 m/min using a mold having a cross sectional size of 160 mm×160 mm. A sinusoidal high frequency magnetic field at a frequency of 10 kHz was imparted to the electromagnetic coil 29, and a power of 200 kW was imparted thereto as a coil load power. Moreover, a step-like current having a pattern as shown in FIG. 1(*b*) was applied to impart a low frequency magnetic field to the electromagnetic coil 30. The magnitude of the magnetic field imparted was 0.3 Tesla as the maximum magnetic flux density. The mold oscillation resistance decreased by 60% when the billet was cast in the manner mentioned above as compared with the resistance in continuously casting in the same manner except that a low frequency magnetic field was not imparted.

Example 9

Figure 16:
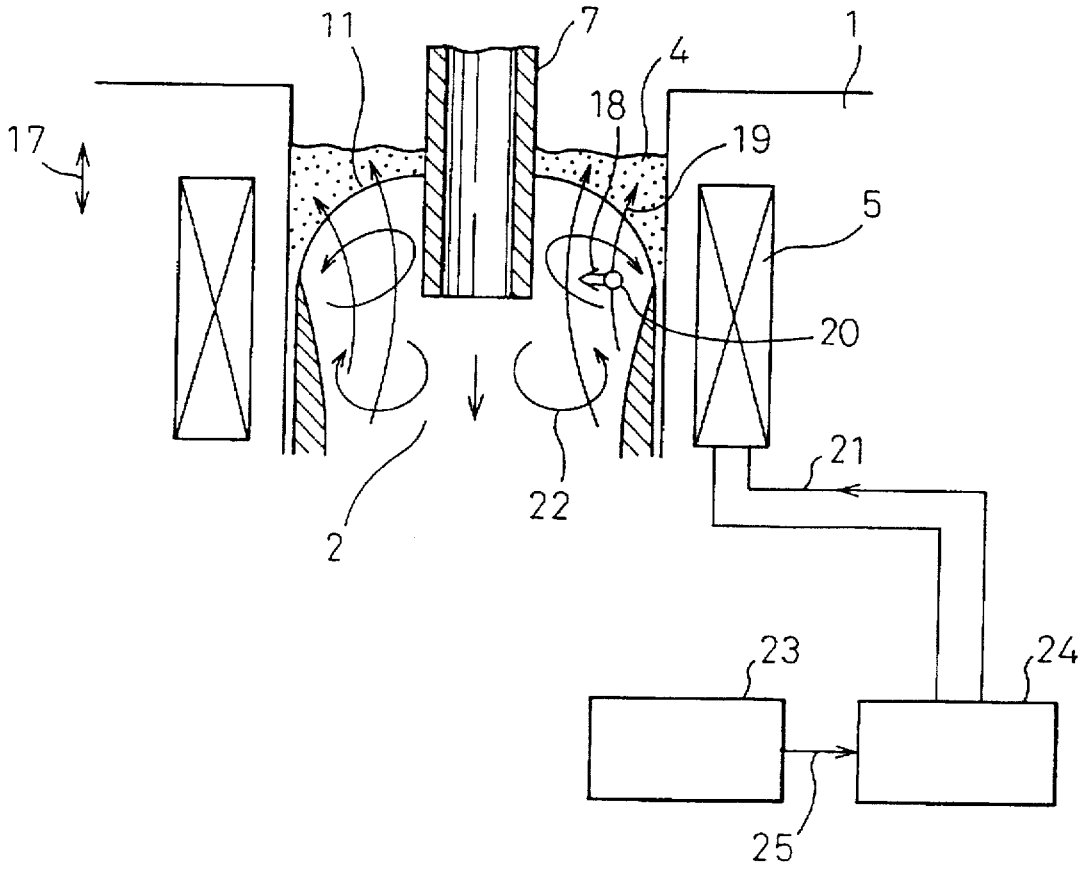
FIG. 16 shows an outline of a continuous casting apparatus according to the present invention.
Figure 17:
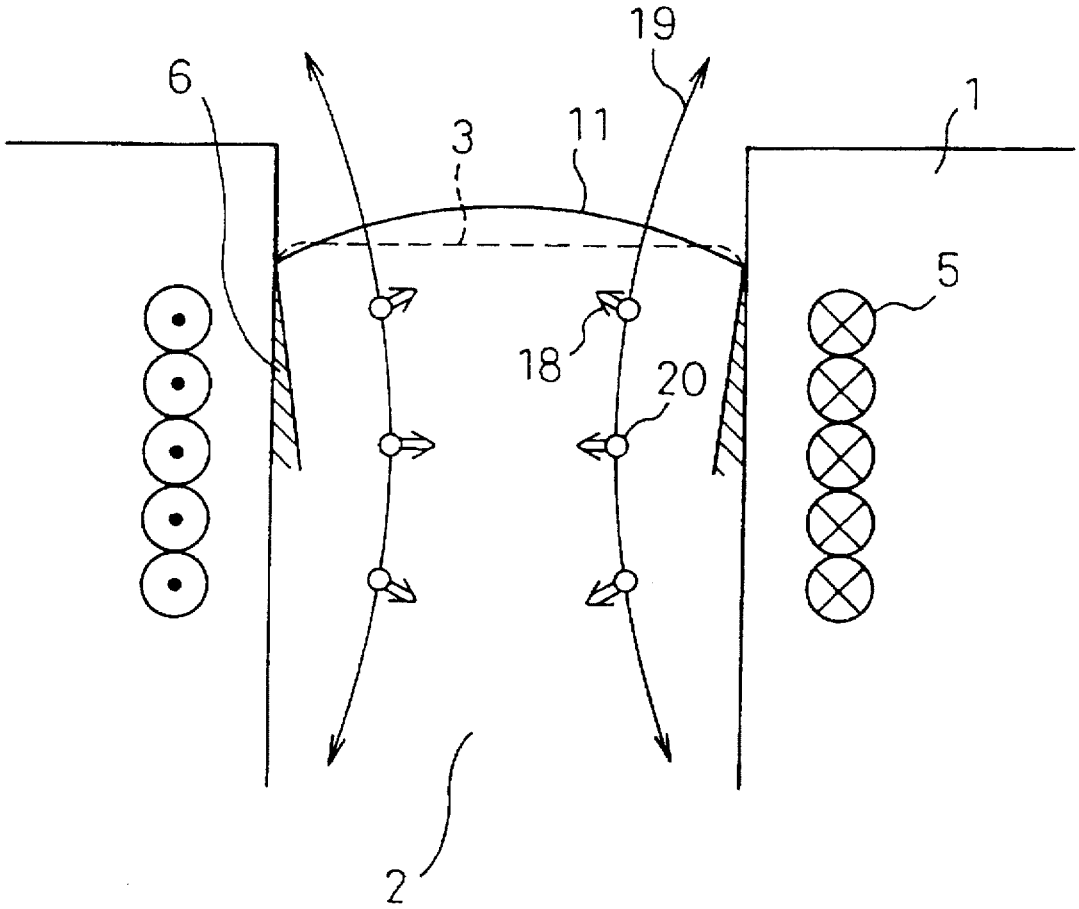
FIG. 17 shows the principle of an electromagnetic force according to present invention.

FIG. 16 shows a schematic view showing one embodiment of an apparatus according to the present invention. A waveform generator 23 was installed for a power source 24 which drove an electromagnetic coil 5. An exciting current 21 was applied to the coil by these devices. First, casting was conducted at a rate of 150 cm/min without applying a current to the electromagnetic coil in the apparatus in FIG. 16. The cast slab thus obtained had on its surface periodically formed concavities and convexities caused by the mold oscillation, and the average surface roughness was 320 μm. Moreover, transverse cracks were formed along the oscillation marks on a part of the surface of the cast slab. Next, using the apparatus of FIG. 16, casting was conducted while an alternating current having an amplitude of 3,000 A and a frequency of 60 Hz was being continuously applied. Surface shrinkage and defects caused by powder inclusions were formed on the cast slab thus obtained. Defects caused by surface shrinkage and powder inclusions are formed in the cast slab, and consequently the cast slab exhibited deteriorated surface properties and deteriorated properties under the surface skin layer compared with a cast slab produced without applying the electromagnetic force. The defects were formed because an agitation flow of the molten metal was generated to make the meniscus unstable.

In the example of the present invention, an alternating current having a frequency of 60 Hz and an amplitude of 3,000 A and a pulse waveform having a period of 0.5 sec were superimposed and applied to the exciting coil. When such excitation was conducted, the high frequency component at 60 Hz was averaged in the electromagnetic force exerted on the molten steel within the mold, and the electromagnetic force was switched on and off every 0.25 sec. The electromagnetic force was applied in synchronization with the ascending movement of the mold, and casting was conducted at a rate of 150 cm/min. The cast slab exhibited a decrease in periodic concavities and convexities and an average surface roughness of 120 μm which was about one-third of the surface roughness of a cast slab obtained without applying the electromagnetic force.

Moreover, the process had the effects of suppressing defect formation under the surface of the cast slab. Furthermore, when casting was carried out at a rate of 200 cm/min, the casting could be stably conducted, and the surface properties and the properties under the surface skin layer of the cast metal were the same as in the case of casting at a rate of 150 cm/min.

Figure 19:
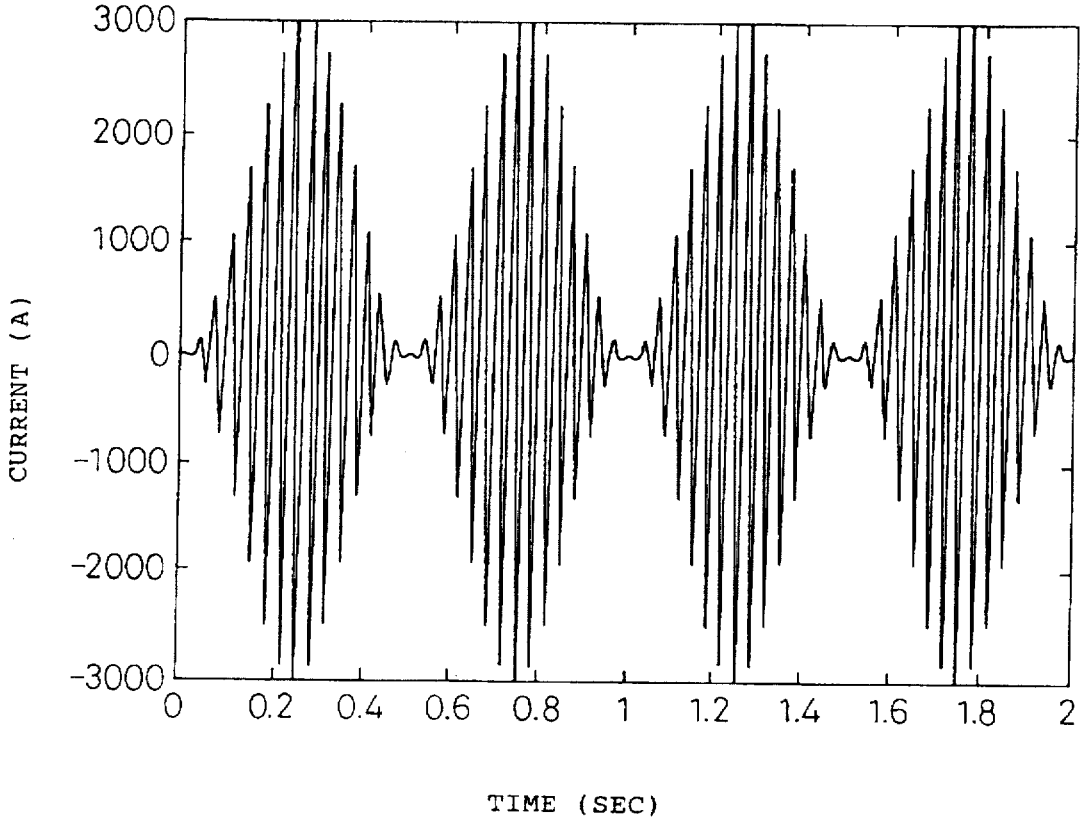
FIG. 19 is a graph showing an example of an amplitude modulated alternating current waveform in the present invention.
Figure 20:
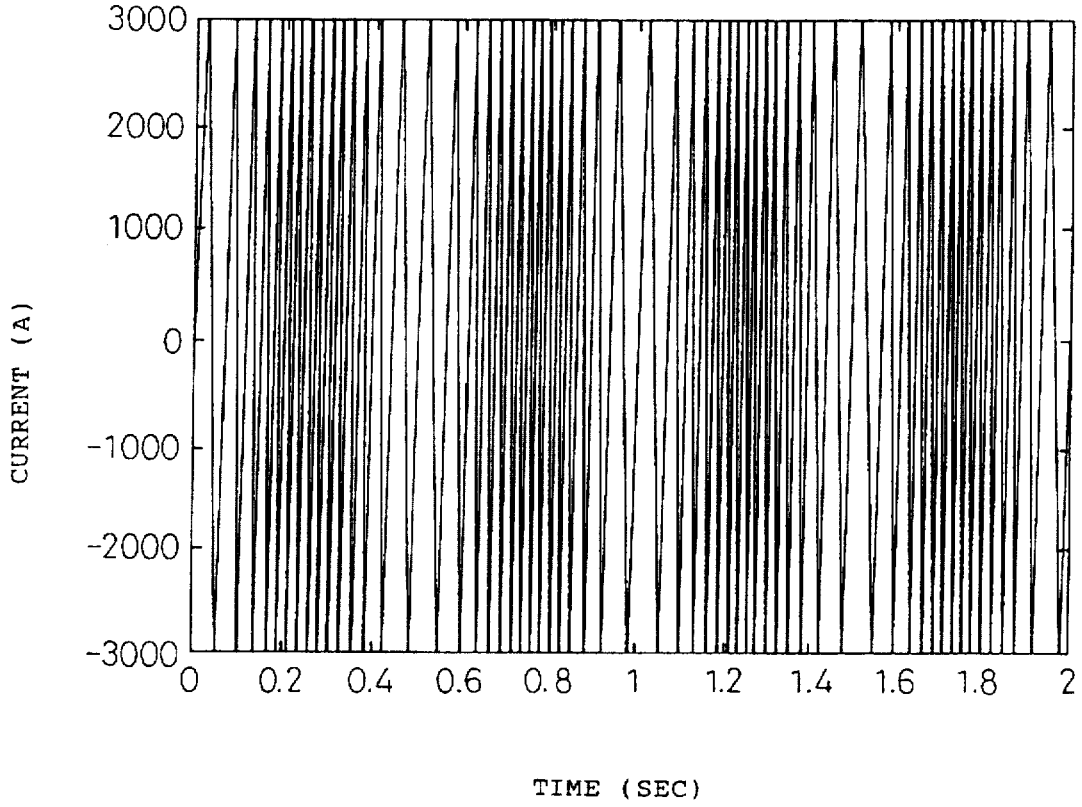
FIG. 20 is a graph showing an example of a frequency modulated alternating current waveform in the present invention.

Next, casting was conducted while the electromagnetic force was applied in synchronization with the descending movement of the mold, with other conditions being the same as mentioned above. The cast slab thus obtained had a surface roughness of 150 μm, and the formation of transverse cracks on the cast slab surface was suppressed. Furthermore, when casting was conducted while there was applied to the exciting coil a current selected from an amplitude-modulated current, a frequency-modulated current or phase-modulated current, a cast slab could be obtained which had the same surface properties as those of the cast slab obtained while the exciting current was being applied. FIG. 19 shows the waveform of an amplitude-modulated alternate current in the present example, and FIG. 20 shows the waveform of a frequency-modulated alternate current therein.

It is evident from these examples that distinct oscillation marks could be formed on the cast slab surface by conducting continuous casting of the molten metal using no lubricant while a pulsed electromagnetic force was being applied without mold oscillation or in synchronization with mold oscillation, and that the cast slab quality and the stability of the casting operation were improved.

As described above, in a process for achieving the improvement of lubrication and the surface quality of a cast slab by exerting an electromagnetic force on the meniscus portion of the molten metal which starts to solidify so that a powder inflow increases, the present invention comprises applying a step-like current consisting of a large current stage which contributes to the meniscus deformation and a small current stage for effecting a function different from that of the large current stage to an electromagnetic coil provided so that it surrounds the meniscus within the mold. The initial solidification thus proceeds stably while powder entrainment caused by the turbulence of the meniscus is prevented, and lubrication and the surface quality of the cast slab may be greatly improved.

Moreover, in the present invention, the initial solidification in continuous casting may be regularly repeated even when a lubricant is not used by carrying out continuous casting while an electromagnetic force in a pulse form or step-like form is being exerted on the meniscus portion of a molten metal which portion starts to solidify. As a result, distinct oscillation marks are formed on the cast slab surface, and the surface properties of the cast slab and the stability of casting may be greatly improved.

We claim:

1. A process for continuously casting a molten metal comprising applying an alternating current to a solenoidal electromagnetic coil which is provided so that it surrounds a continuous casting mold wall or is embedded in the side wall of the mold, whereby an electromagnetic force exerted on the molten metal poured into the mold and being solidified is applied in the direction of separating the molten metal from the mold wall, said process comprising periodically changing the amplitude or waveform of the alternating current to be applied whereby lubrication and the surface properties of the cast slab are improved.

2. The process for continuously casting a molten metal according to claim 1, wherein the ratio of an application time of the large current which contributes to the meniscus deformation to a time of applying the current per cycle is defined to be from at least 0.2 to up to 0.8, so that the lubrication and the surface properties of the cast slab are improved.

3. The process for continuously casting a molten metal according to claim 1, wherein a lubricant is not used or a substance such as rape seed oil which does not exist as a liquid state on the meniscus of the molten metal is used, and an alternating current containing a step-like current or pulsed one is applied to the electromagnetic coil.

4. The process for continuously casting a molten metal according to claim 3, wherein the period of applying the electromagnetic force is synchronized with the oscillation period of the mold, and the application stage is in the negative strip stage where the lowering speed of the mold is higher than the casting rate, so that uniform oscillation marks are formed, in the peripheral direction, on the cast slab surface.

5. The process for continuously casting a molten metal according to claim 3, wherein the period of applying the electromagnetic force is synchronized with the oscillation period of the mold, and the application stage is in the positive strip stage where the lowering speed of the mold is lower than the casting rate, so that oscillation marks on the cast slab are removed or made shallow.

6. The process for continuously casting a molten metal according to claim 1, wherein an alternating current which changes with a high frequency and a low frequency within one period of the electromagnetic waveform is applied to the electromagnetic coil, so that an electromagnetic force which changes in accordance with the frequency of the alternating current is applied to the molten metal having been poured into the mold.

7. The process for continuously casting a molten metal according to claim 1, wherein the alternating current applied to the electromagnetic coil is an amplitude-modulated one, a frequency-modulated one or phase-modulated one.

8. A process for continuously casting a molten metal comprising applying an alternating current to a solenoidal electromagnetic coil which is provided so that it surrounds a continuous casting mold wall or is embedded in the side wall of the mold, whereby an electromagnetic force is exerted on the molten metal poured into the mold which oscillates with a constant mode and being solidified, said process comprising periodically changing the amplitude or waveform of the alternating current to be applied in synchronization with the oscillation cycle of the mold to make the alternating current a step-like one consisting of a large amplitude current for changing the meniscus configuration and a small current, whereby lubrication and the surface properties of the cast slab are improved.

9. The process for continuously casting a molten metal according to claim 8, wherein said mold oscillator has a frequency ($f_m$) and said alternating current has a frequency ($f_p$), and the mold oscillation ($f_m$) and the frequency of the alternating current ($f_p$) are set in a range defined by the formula: $0.69 \leqq \ln(f_p/f_m) \leqq 9.90$.

10. The process for continuously casting a molten metal according to claim 8, wherein (1) modulated current is applied to the electromagnetic coil;

said signal waves of the modulated current have a frequency ($f_s$), said mold oscillation has a frequency ($f_m$); and said carrier waves of the modulated current have a frequency ($f_c$); wherein (2) the frequency of the signal waves of the modulated current ($f_s$) is set at the frequency of the mold oscillation ($f_m$), and (3) the frequency of the carrier waves of the modulated current ($f_c$) and the frequency of the mold oscillation ($f_m$) are set in a range defined by the formula: $0.69 \leqq \ln(f_c/f_m) \leqq 9.90$, in place of applying an alternating current the amplitude of which is periodically increased and reduced.

11. A process for continuously casting a molten metal comprising applying an alternating current to a solenoidal electromagnetic coil which is provided so that it surrounds a continuous casting mold wall or is embedded in the side wall of the mold, whereby an electromagnetic force is exerted on the molten metal poured into the mold and being solidified, said process comprising periodically changing the amplitude or waveform of the alternating current to be applied to make the alternating current a step-like one consisting of a large current for changing the meniscus configuration and a small amplitude current, whereby lubrication and the surface properties of the cast slab are improved.

12. The process for continuously casting a molten metal according to claim 11, wherein the ratio of an application time of the large current which contributes to the meniscus deformation to a time of applying the current per cycle is defined to be from at least 0.2 to up to 0.8, so that the lubrication of the surface properties of the east slab are improved.

13. The process for continuously casting a molten metal according to claim 11, wherein the ratio of an application time of the large current which contributes to the meniscus deformation to a time of applying the current per cycle is defined to be from at least 0.2 to up to 0.8, so that the lubrication of the surface properties of the cast slab are improved.

14. A process for continuously casting a molten metal comprising applying an alternating current to a solenoidal electromagnetic coil which is provided so that it surrounds a continuous casting mold wall or is embedded in the side wall of the mold, whereby an electromagnetic force is exerted on the molten metal poured into the mold which oscillates with a constant mode and being solidified, said process comprising periodically changing the amplitude or waveform of the alternating current to be applied in synchronization with the oscillation cycle of the mold to make the alternating current a pulsed one consisting of a current stage for changing the meniscus configuration and a non-current stage, whereby lubrication and the surface properties of the cast slab are improved.

15. A process for continuously casting a molten metal using no lubricant or using a substance such as rape seed oil which does not exist as a liquid state on the meniscus of the molten metal, said process comprising applying an alternating current which is periodically changed in amplitude or waveform to an electromagnetic coil provided around the outer periphery of the wall of a continuous casting mold without oscillation so that an electromagnetic force which changes in accordance with the alternating current is exerted on the molten metal poured into the mold, whereby marks corresponding to oscillation marks are formed on the mold surface.

16. A process for continuously casting a molten metal comprising applying an alternating current to a solenoidal electromagnetic coil which is provided so that it surrounds a continuous casting mold wall or is embedded in the side wall of the mold, whereby an electromagnetic force is exerted on the molten metal poured into the mold which oscillates with a constant mode and being solidified, said process comprising making the repeatedly applied alternating current a step-like one consisting of a large current and a small current per cycle so that the mold wall oscillates in the direction vertical to the casting one, whereby lubrication and the surface properties of the cast slab are improved.

17. A process for continuously casting a molten metal comprising applying an alternating current to a solenoidal electromagnetic coil which is provided so that it surrounds a continuous casting mold wall or is embedded in the side wall of the mold, whereby an electromagnetic force is exerted on the heating mold and the molten metal poured into the mold and being solidified which mold oscillates in a constant mode in the casting direction, said process comprising making the repeatedly applied alternating current a step-like one consisting of a large current stage and a small current stage per cycle so that the temperature of the heated mold is adjusted and an electromagnetic pinching force is exerted on the molten metal on the mold or the metal which is in a semi-solidified state and is being solidified on the mold to separate the metal from the mold, whereby the contact resistance between the solidifying metal and the mold is alleviated and a cast slab excellent in surface properties is obtained.

18. A process for continuously casting a molten metal comprising making an alternating current, which is periodically changed in amplitude or waveform, and which is applied to an electromagnetic coil, step-like so that a cooling mold wall which is not oscillated in the casting direction is oscillated in the direction vertical to the casting direction and the temperature of the heating mold is adjusted, whereby the contact resistance between the metal having started to solidify and the mold wall is alleviated and lubrication and the surface properties of the cast slab are improved.

* * * * *